US007731571B2

(12) United States Patent
Fukinuki et al.

(10) Patent No.: US 7,731,571 B2
(45) Date of Patent: Jun. 8, 2010

(54) ELECTRIC SANDING MACHINE

(75) Inventors: Masatoshi Fukinuki, Nanjing (CN); Gan Wei, Nanjing (CN)

(73) Assignee: Chervon Limited, Kwai Chung (HK)

( * ) Notice: Subject to any disclaimer, the term of this patent is extended or adjusted under 35 U.S.C. 154(b) by 0 days.

(21) Appl. No.: 12/109,731

(22) Filed: Apr. 25, 2008

(65) Prior Publication Data

US 2008/0318500 A1 Dec. 25, 2008

(30) Foreign Application Priority Data

Jun. 25, 2007 (CN) ..... 2007 2 0040193 U

(51) Int. Cl.
*B24B 23/00* (2006.01)

(52) U.S. Cl. ..... 451/357; 451/344

(58) Field of Classification Search ..... 451/344, 451/357, 356, 359, 353
See application file for complete search history.

(56) References Cited

U.S. PATENT DOCUMENTS 2,395,537 A * 2/1946 Crosby ..... 451/357
2,764,852 A * 10/1956 Emmons ..... 451/356
2,885,833 A * 5/1959 Neff ..... 451/356
2,893,174 A * 7/1959 Jepson ..... 451/344
2,893,175 A * 7/1959 Bruck ..... 451/356
4,242,839 A * 1/1981 Armbruster et al. ..... 451/357
5,419,737 A * 5/1995 Brazell et al. ..... 451/453
6,942,557 B2 9/2005 Sun
7,291,062 B2 * 11/2007 Kiss et al. ..... 451/356
2003/0228833 A1 12/2003 Boyer

* cited by examiner

*Primary Examiner*—Robert Rose
(74) *Attorney, Agent, or Firm*—Greenberg Traurig, LLP

(57) ABSTRACT

An electric sanding machine has a housing with a drive device disposed therein, a base plate disposed under the housing, and a driven shaft for driving the base plate. A sanding device is attached to the base plate. The housing has a drive device housing part substantially perpendicular to the base plate and a grip housing part substantially parallel to the base plate. A cross section of the housing in a vertical direction is substantially L-shaped. The drive device is disposed in the drive device housing part while the driven shaft is located in the grip housing part so that the drive device is departed from the driven shaft in a radius direction of the driven shaft. With this arrangement, the sanding machine is provided with stronger power and has a smaller contour size which may be controlled more effectively.

21 Claims, 4 Drawing Sheets

ELECTRIC SANDING MACHINE

BACKGROUND

The following generally relates to a portable power tool and, more particularly, relates to an improved electric sanding machine.

In the art of power tools, electric sanding machines are known. A commonly used electric sanding machine shown in FIG. 1 comprises a housing 1, a base plate 2 with an abrasive sheet attached thereon, and handles mounted on the housing. For convenience of operation, a main handle 3 and an auxiliary handle 4 are respectively connected to the rear side and the front side of the housing 1. A dust vent 5 is defined on the rear side of the housing 1 for permitting escape of dust created due to the sanding operation and sucked from holes (not shown) on the base plate.

To satisfy requirements of sanding power, the above described sanding machine typically is installed with a relatively large sized motor which occupies a lot of space and increases the height of the sanding machine. Furthermore, the above structural arrangement results in a sanding machine with the main handle being positioned near the top of the housing which is not on the line of the gravity center of the machine which thus causes the sanding machine to be difficult to control effectively only by gripping the main handle. While the operator may grip both the main handle and the auxiliary handle with two hands to smoothly perform the sanding operation, there is a disadvantage in that the operator no longer has a free hand to do other assistant work for the sanding operation. The above structural arrangement further results in the operation position being far from the working surface which also makes the machine not very easy to control to achieve a good work especially when a surface to be sanded is on a special position, such as ceiling, vertical wall, object in a narrow space, and so on. Still further, in order to collect the dust escaping from the dust vent, the dust vent is commonly connected with a dust collection box or an exhausting duct which also increase the contour size of the sanding machine.

SUMMARY

The following describes an improved electric sanding machine having a relatively smaller contour for more convenient operation. More particularly, the electric sanding machine comprises a housing with a drive device therein, a base plate disposed under the housing, and a driven shaft for driving the base plate. The shaft is connected with the drive device through a transmission mechanism. The housing comprises a grip housing part which is substantially parallel to the base plate. The drive device comprises at least two motors. A conventionally used, bigger motor is replaced with at least two motors having relatively smaller size to provide stronger power, a lower center of gravity, a decrease in the overall height and width of the sanding machine, and space for a grip portion. An ergonomic grip housing part is thereby provided near the center of the gravity of the sanding machine so that the sanding movement of the machine may be controlled more easily and effectively.

In a further embodiment of the sanding machine a dust collection box is mounted on the housing. The partial outer surfaces of the dust collection box smoothly joins the surface of the housing.

In a still further embodiment of the sanding machine a battery pack is mounted on the housing. The partial outer surfaces of the battery pack smoothly joins the surface of the housing.

The arrangement of the dust collection box or the battery pack also makes the sanding machine compacter in structure and smaller in size.

A better appreciation of the objects, advantages, features, properties, and relationships of the disclosed tool will be obtained from the following detailed description and accompanying drawings which set forth illustrative embodiments which are indicative of the various ways in which the principles described hereinafter may be employed

BRIEF DESCRIPTION OF THE DRAWINGS

For use in better understanding the subject electric sanding device described hereinafter reference may be had to the following drawings in which.

DETAILED DESCRIPTION

Figure 1:
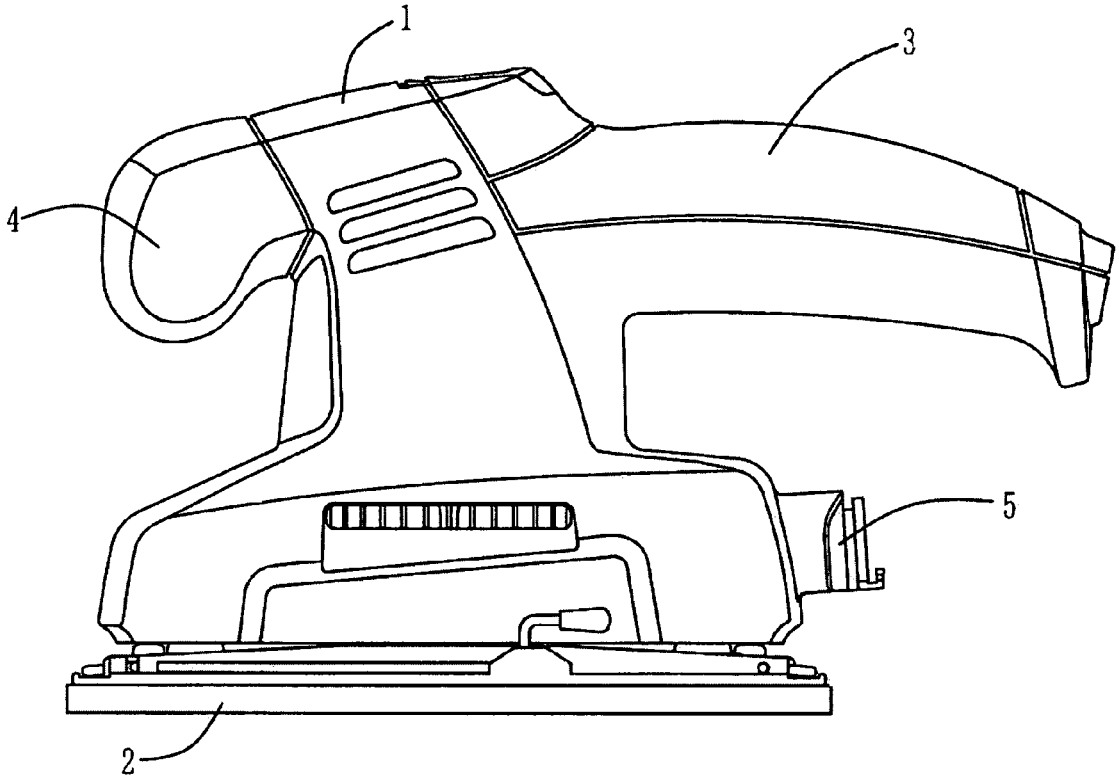
Fig. 1 (PRIOR ART)
FIG. 1 is a schematic view of an electric sanding machine in the prior art.
Figure 2:
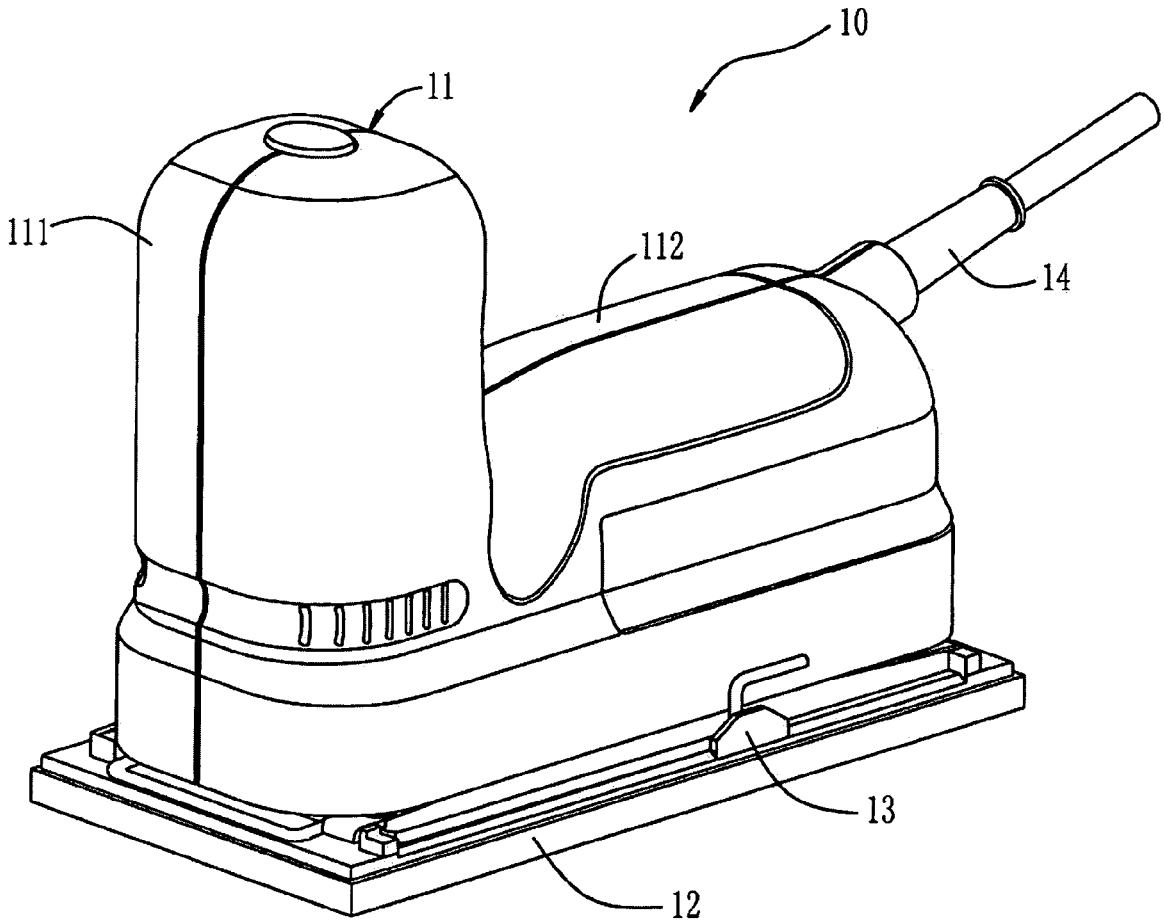
FIG. 2 is a schematic view of a first exemplary electric sanding machine constructed according to the present invention.

As shown in FIG. 2, a first, exemplary sanding machine 10 constructed according to the present invention comprises a housing 11 having a driving mechanism therein and a base plate 12 disposed under the housing 11. The housing 11, which has a substantially L-shaped cross section in the vertical direction, comprises a drive mechanism housing part 111 and a grip housing part 112, which are substantially perpendicular to each other. The grip housing part 112 that is substantially parallel to the base plate 12 and which is partially covered by rubber material or other soft material to enhance grip comfort. An abrasive sheet or other sanding sheet may be attached to the base plate 12 through a clamping means 13 for sanding the surface of a workpiece. An electrical cord 14 extends from the rear portion of the housing 11 and is connected to a power source to power the drive mechanism.

Figure 3:
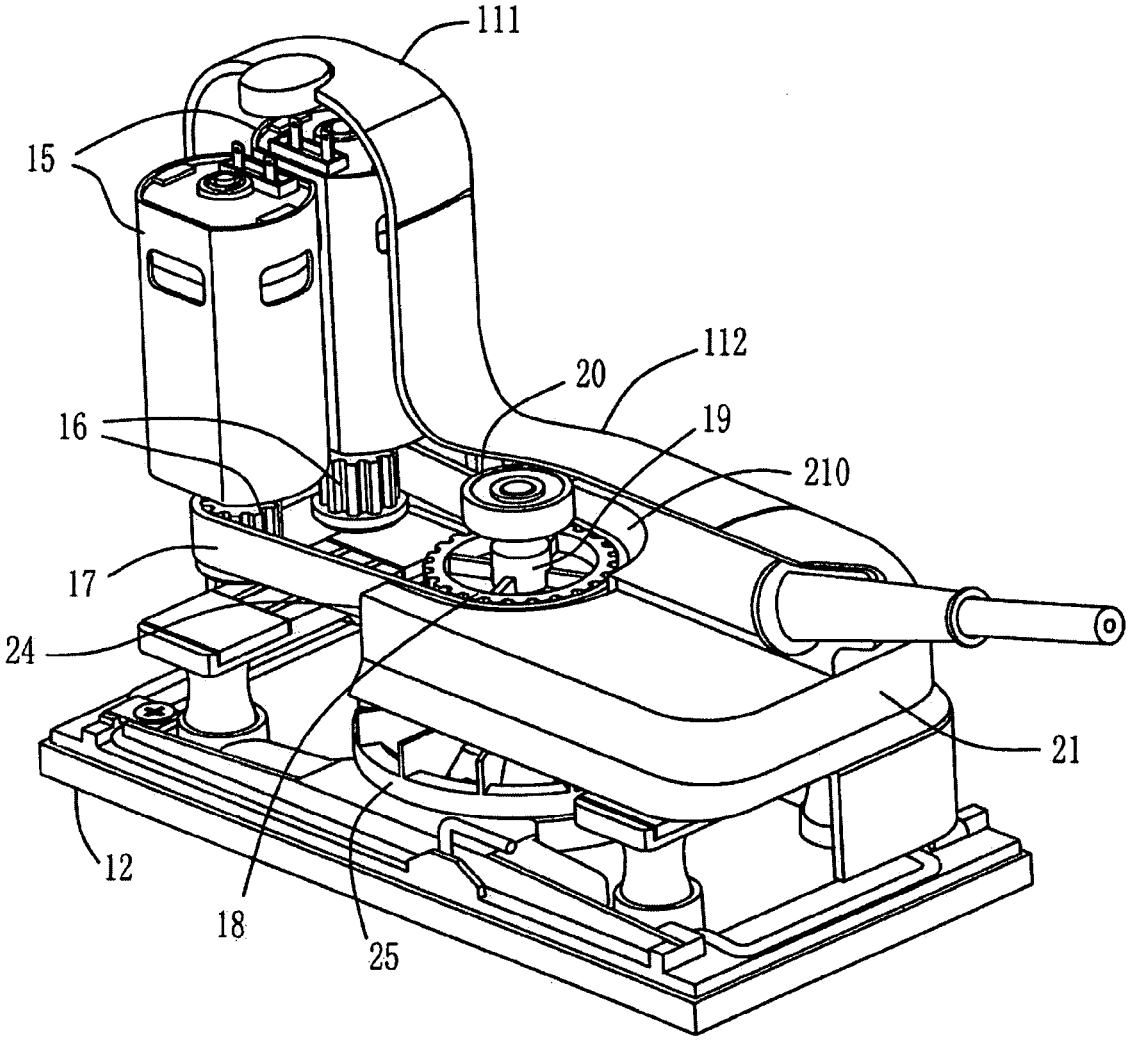
FIG. 3 is a partial cutaway view of the exemplary sanding machine of FIG. 2.

With reference to FIG. 3, the internal construction of the sanding machine 10 is shown. The sanding machine 10 comprises two motors 15 having the same standard and being disposed side by side within the drive mechanism housing part 111 with their two drive-shaft axes parallel to each other and substantially perpendicular to the base plate 12. The shafts of the two motors 15 are respectively connected with two small belt pulleys 16 in the same size. The two small belt pulleys 16 are connected to a big belt pulley 18 through a belt 17 to form a belt transmission mechanism. The big belt pulley 18 is mounted on a driven shaft 19 which is supported within the housing 11 through a bearing 20 at its one end. A fan 25 is fixed on the other end of the driven shaft 19. The distances between each motor 15 and the driven shaft 19 are substantially equal. The base plate 12 is driven by the driven shaft 19 to perform desirable movements.

The transmission method between the motors 15 and the driven shaft 19 is not restricted to the aforementioned belt transmission and, as such, other appropriate methods such as gear transmission may be utilized.

The sanding machine 10 further comprises a dust collection box 21 arranged under the grip housing part 112. The dust collection box 21 is disposed in the housing 11 in a drawer manner and may be slid into the housing 11. The three outer surfaces of the dust collection box 21 smoothly join the surface of the housing 11 for forming an integral unit. The dust collection box 21 is provided with an inlet opening 24 and a semicircle recess 210 near the big belt pulley 18. The semicircle recess 21 has a radius a little bigger than the radius of the big belt pulley 18 and surrounds a part of the circumference of the big belt pulley 18 which make the sanding machine more compact. During the sanding operation of the sanding machine 10 the fan 25 is rotated together with the driven shaft 19 to eject the dust collected from a channel (not shown) on the base plate 12 to the dust collection box 21.

As noted, two motors are utilized each of which is smaller in size than a traditional motor so that the height of the housing of the sanding machine is reduced greatly. Therefore, the center of gravity of the sanding machine is lowered and the movement of the machine becomes smoother, while each motor is narrower in a transverse direction so that enough gripping space is allowed on the grip housing part 112. The grip housing part 112 is disposed at a lower position near the center of gravity of the sanding machine so that the sanding machine may be controlled effectively. Furthermore, the dust collection box is arranged in the housing as a part of the housing so that the sanding machine has a smaller contour size and compacter structure.

Figure 4:
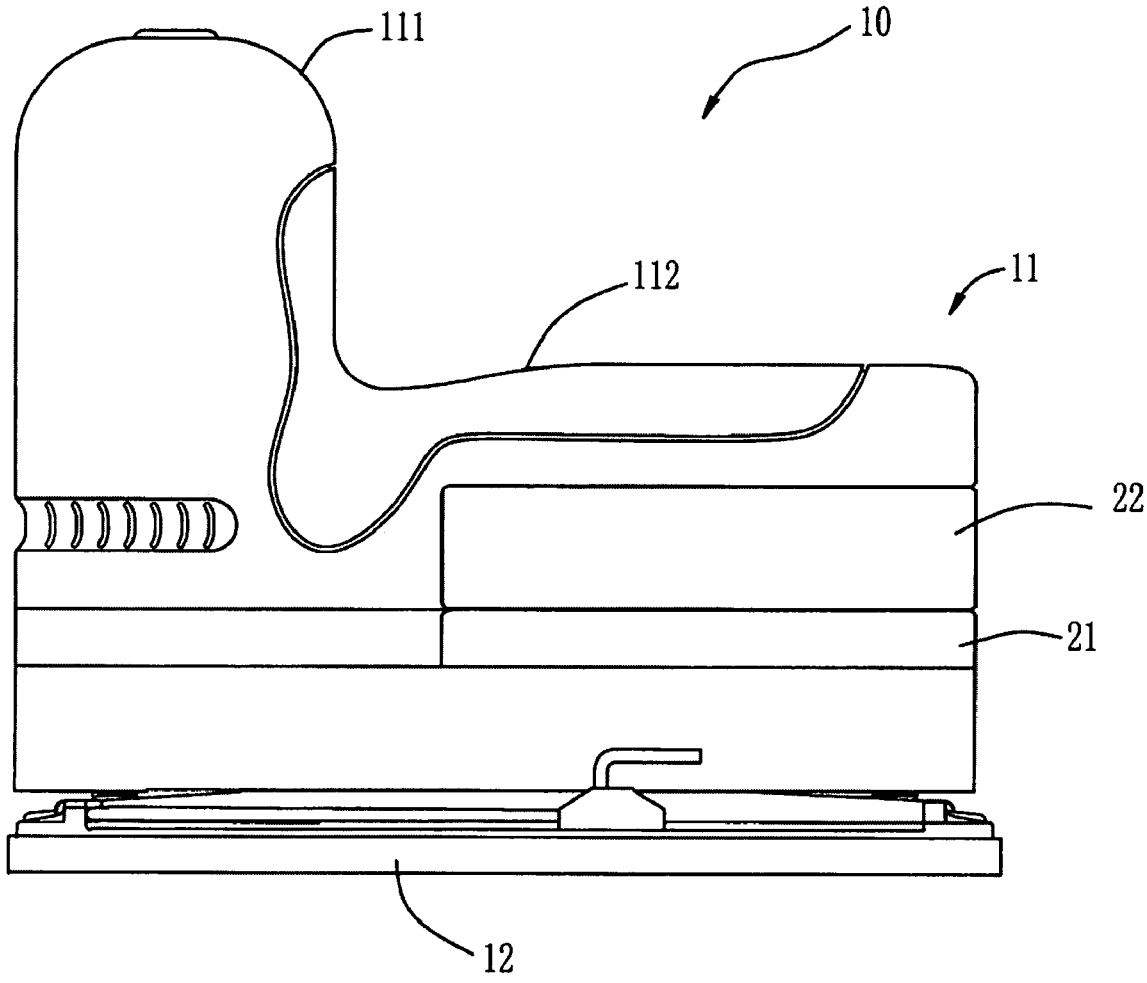
FIG. 4 is a side view of a further, exemplary sanding machine constructed according to the present invention.

With reference to FIG. 4, a further embodiment according to the present invention is illustrated. Wherever possible, the same components as used in the first described embodiment are designated with the same reference numerals. In the second embodiment, the sanding machine 10 comprises a battery pack 22 which is disposed between the grip housing part 112 and the dust collection box 21. The three outer surfaces of the battery pack 22 are formed as a part of the housing. The two motors in this embodiment, which are powered by the battery pack 22, may be direct current powered motors or motors capable of being selectively powered by alternating current or direct current.

The present invention is not restricted as the embodiments disclosed hereinabove. Accordingly, any substitutes and modifications according to the spirit of the present invention will be regarded as falling within the claims appended hereto.

What is claimed is:

1. An electric sanding machine, comprising:

a housing with a drive device therein;

a base plate disposed under the housing; and a driven shaft for driving the base plate;

wherein the housing comprises a grip housing part substantially parallel to the base plate; the drive device is connected with the driven shaft through a transmission mechanism; and the drive device includes at least two motors.

2. The electric sanding machine of claim 1, wherein the housing further comprises a drive device housing part which is departed from the driven shaft in a radius direction of the driven shaft and the drive device is disposed in the drive device housing part.

3. The electric sanding machine of claim 2, wherein the drive device housing part is substantially perpendicular to the base plate and the drive device housing part cooperates with the grip housing part to form an "L" shape in a vertical direction.

4. The electric sanding machine of claim 1, wherein the driven shaft is under the grip housing part.

5. The electric sanding machine of claim 1, wherein the at least two motors have corresponding axes which are parallel to each other and the at least two motors are disposed side by side.

6. The electric sanding machine of claim 5, wherein the axes of the at least two motors are substantially perpendicular to the base plate and distances between each axis and the driven shaft are substantially equal.

7. The electric sanding machine of claim 1, comprising a dust collection box is mounted within the housing and partial outer surfaces of the dust collection box smoothly join an outer surface of the housing.

8. The electric sanding machine of claim 7, wherein the dust collection box is slidable into the housing in a drawer-like manner.

9. The electric sanding machine of claim 1, wherein the grip housing part is partially covered with soft material.

10. The electric sanding machine of claim 1, comprising a battery pack is mounted in the housing and partial outer surfaces of the battery pack smoothly join the outer surface of the housing.

11. An electric sanding machine, comprising:

a housing with a drive device disposed therein, the housing comprising a grip housing pan and a drive device housing part with a top of the drive device housing pan being positioned higher than a top of the grip housing part such that the drive device housing part and the grip housing part cooperate to form an "L" shape in a vertical direction;

a driven shaft connected with the drive device through a transmission mechanism; and a base plate disposed under the housing and driven by the driven shaft;

wherein the drive device comprises a first motor having an axis which is departed from the driven shaft in a radius direction of the driven shaft and a second motor having an axis which is also departed from the driven shaft in a radius direction of the driven shaft.

12. The electric sanding machine of claim 11, wherein the drive device is disposed in the drive device housing part, and the drive device housing part is departed from the driven shaft in a radius direction of the driven shaft.

13. The electric sanding machine of claim 11, wherein the grip housing part is substantially parallel to the base plate.

14. The electric sanding machine of claim 11, wherein the axis of the first motor is substantially perpendicular to the base plate.

15. The electric sanding machine of claim 14, wherein the drive device housing part is substantially perpendicular to the base plate.

16. The electric sanding machine of claim 11, wherein partial outer surfaces of the grip housing part smoothly join an outer surface of the drive device housing part.

17. The electric sanding machine of claim 11, wherein the first motor and the second motor are arranged in the housing side by side.

18. The electric sanding machine of claim 11, wherein the axis of the second motor is substantially perpendicular to the base plate.

19. The electric sanding machine of claim 11, wherein a distance between the axis of the first motor and the driven shaft is substantially equal to that between the axis of the second motor and the driven shaft.

20. The electric sanding machine of claim 11, wherein an upper surface of the grip housing part is substantially level with a lower end of the first motor.

21. The electric sanding machine of claim 11, comprising a battery pack mounted between the grip housing part and the base plate and wherein at least a portion of a surface of the housing comprises at least a portion of a surface of the battery pack.

* * * * *